US008130064B2

(12) United States Patent
Moeller et al.

(10) Patent No.: US 8,130,064 B2
(45) Date of Patent: Mar. 6, 2012

(54) SWITCHING DEVICE

(75) Inventors: Matthew Len Moeller, Rock Falls, IL (US); David Glen Parker, Trinity, NC (US); Kurt Thomas Zarbock, Advance, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 323 days.

(21) Appl. No.: 12/184,431

(22) Filed: Aug. 1, 2008

(65) Prior Publication Data

US 2010/0026427 A1 Feb. 4, 2010

(51) Int. Cl.
*H01H 67/02* (2006.01)

(52) U.S. Cl. ..... 335/131; 335/78; 335/128

(58) Field of Classification Search ..... 335/124, 335/131

See application file for complete search history.

(56) References Cited

U.S. PATENT DOCUMENTS

| | | | | |
|---|---|---|---|---|
| 2,521,969 | A | 9/1950 | Dugan | |
| 3,997,861 | A * | 12/1976 | Van Sickle | 335/161 |
| 4,388,535 | A | 6/1983 | Wiktor et al. | |
| 4,430,579 | A | 2/1984 | Wiktor | |
| 4,529,953 | A | 7/1985 | Myers | |
| 4,562,418 | A | 12/1985 | Bachler | |
| 5,227,750 | A | 7/1993 | Connell et al. | |
| 5,515,019 | A | 5/1996 | Schedele | |
| 5,684,442 | A | 11/1997 | Hufschmid | |
| 5,694,099 | A | 12/1997 | Connell et al. | |
| 6,046,660 | A * | 4/2000 | Gruner | 335/78 |
| 6,046,661 | A | 4/2000 | Reger et al. | |
| 6,292,075 | B1 * | 9/2001 | Connell et al. | 335/185 |
| 6,320,485 | B1 | 11/2001 | Gruner | |
| 6,563,409 | B2 | 5/2003 | Gruner | |
| 6,621,393 | B2 | 9/2003 | Comtois et al. | |
| 6,628,184 | B1 | 9/2003 | Cassagrande et al. | |
| 6,816,353 | B2 * | 11/2004 | Mani et al. | 361/160 |
| 7,423,504 | B2 * | 9/2008 | Kon et al. | 335/133 |
| 2004/0048521 | A1 * | 3/2004 | Hogue et al. | 439/775 |
| 2008/0157905 | A1 | 7/2008 | Parker et al. | |
| 2008/0231397 | A1 * | 9/2008 | Katou | 335/192 |

FOREIGN PATENT DOCUMENTS

| | | |
|---|---|---|
| DE | 23 15 567 | 10/1974 |
| FR | 2 899 721 | 10/2007 |
| WO | WO 2006/024855 | 3/2006 |
| WO | WO 2006/035235 | 4/2006 |

OTHER PUBLICATIONS

International Search Report, International Application No. PCT/US2009/004367, International Filing Date Jul. 29, 2009.

* cited by examiner

*Primary Examiner* — Bernard Rojas

(57) ABSTRACT

The invention is directed to a switch assembly which can be used in situation in which the switch accommodates the flow of high voltage current. An actuator assembly with moveable contacts is moved by a motor driven armature. The moveable contacts are in electrical engagement with the stationary contacts when the armature is in the first position, and the moveable contacts are spaced from the stationary contacts when the armature is in the second position. By angling the stationary contacts and moveable contacts, the linear motion of the armature causes the moveable contacts to move across the surface of the stationary contacts as the armature approaches the first position. As all of the movements of the assembly are in a direction parallel to the axis of the armature, the assembly can be manufactured and operated reliably in a relatively small space. In addition, the linear movement on the angled contact provides for a positive electrical connection even in adverse environments.

19 Claims, 8 Drawing Sheets

SWITCHING DEVICE

FIELD OF THE INVENTION

The present invention is directed to electromagnetic switches and to contact systems related thereto and, in particular, to electromagnetic switches which can operate under high current conditions.

BACKGROUND OF THE INVENTION

Electromagnetic switches and relays known in the art typically consist of a multi-turn coil wound on an iron core forming an electromagnet. The coil electromagnet is energized by passing current through the multi-turn coil to magnetize the core. The magnetized coil attracts an armature to a first position, which is pivoted to connect or disconnect one or more sets of contacts. When no current is passed through the coil or the polarization of the current is reversed, the coil is moved to a second position in which the contacts are disconnected or connected respectively.

While these switching devices operate satisfactorily in normal applications, it has been found that under extremely high current conditions, e.g. short-circuit conditions, a repulsion force is generated which tends to part the pairs of contacts, which may cause serious damage to the switching device.

U.S. Pat. No. 5,694,099 discloses a switching device which can operate under high current conditions. The switching device has a solenoid actuator with a plunger and a pivot arm. The pivot arm has one end coupled to an outer end of the plunger and the other end bridging and engaging a moving switch blade of the switching assembly. Within the bridging member of the pivot arm, a compression spring is seated to engage the moving blade and provide a further positive pressure to hold the moving contact in engagement with the fixed contact when the pivot arm is in the position to cause the fixed and moving contacts to engage. When the switch is in the "made" condition, the flow of the same current in opposite directions in the parallel paths, which respectively comprise the inlet bus-bar and the moving switch blade, generates an electrodynamic force between them, tending to move the switch blade away from the fixed inlet bus-bar thereby increasing the force applied to the moving contact, and thus resisting any tendency of the contacts to separate under conditions of high current.

High current switch devices, such as those described above, provide adequate switching. However, these devices, and in particular the pivoting arms, tend to be relatively complicated, which increases the cost and increases the overall size of the switching device. It would, therefore, be beneficial to provide a switching device which could be used in high current environments, but which wall easy and inexpensive to manufacture and which could operate effectively in a reduced space.

SUMMARY OF THE INVENTION

The invention is directed to a switch assembly which can be used in a situation in which the switch accommodates the flow of high voltage current. The switch assembly has a housing through which stationary contacts extend. The stationary contacts are configured to accept high voltage current thereon. A motor assembly is provided to drive an armature between a first position and a second position. An actuator assembly with moveable contacts is moved by the armature such that the moveable contacts are in electrical engagement with the stationary contacts when the armature is in the first position, and the moveable contacts are spaced from the stationary contacts when the armature is in the second position.

The invention is also directed to a switch assembly in which stationary contacts and moveable contacts may be angled with respect to the direction of motion as the armature is moved between the first position and the second position. By angling the contacts and terminals, the linear motion of the armature causes the moveable contacts to move across the surface of the stationary contacts as the armature approaches the first position. This provides a wiping action to remove contamination that may be present on the surfaces of the stationary contacts and moveable contacts. The angling also provides an increase in the contact force for a given spring force.

The invention is also directed to a switch assembly that is magnetically latching. The device will utilize an AC signal to actuate by a pulse of the positive or negative cycle of the signal. The device could also be configured to utilize a DC signal. The coil only needs to be energized for a short duration to close the switch and again to open. The invention is also directed to a switch assembly in which the armature has a coupler attached thereto. The coupler is fabricated from a non-magnetic material and the armature is fabricated from a material which exhibits magnetic properties when exposed to a magnetic field.

The invention provides a low cost high voltage switch assembly which can be easily produced. As all of the movements of the assembly are in a direction parallel to the axis of the armature, the assembly can be manufactured and operated reliably in a relatively small space. In addition, the linear movement on the angled contact provides for a positive electrical connection even in adverse environments.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
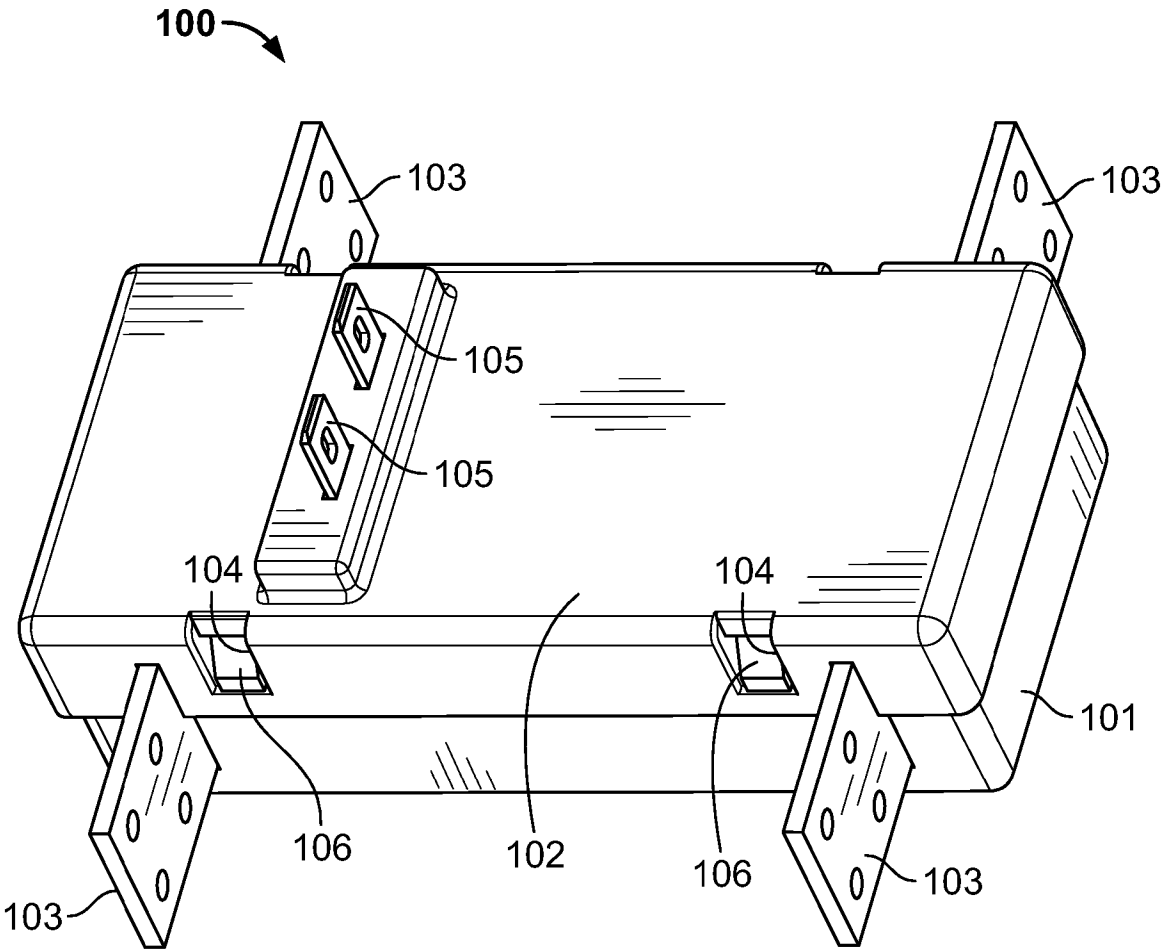
FIG. 1 is a top perspective view of a fully assembled switch according to the present invention.

FIG. 1 shows a high current 200A switch or relay assembly 100 according to an embodiment of the present invention. While a high current switch is shown, aspects of this invention are equally applicable to all switches or relays. The switch assembly 100 includes a base housing 101 and a cover 102. Openings 104 in cover 102 receive latches 106 of base housing 101 therein to effectively latch the cover 102 to the base housing 101. The base housing 101 is configured with switch terminals 103 extending therethrough into the interior of base housing 101, providing electrical connectivity between switch terminals 103 and components within the base housing 101. Specifically, switch terminals 103 are in electrical communication with stationary contacts 203 (see, e.g. FIG. 2). In addition, coil terminals 105 extend through the cover 102 into the interior of the housing 101, providing electrical connectivity between coil terminals 105 and components within housing 101. Specifically, coil terminals 105 are in electrical communication with coil assembly 205 (see, e.g., FIG. 2). Although switch terminals 103 are shown as contact plate connections and coil terminals 105 are shown as contact blade connections, the switch terminals 103 and coil terminals 105 may be any suitable electrical connection that allows connection of electrical wiring or electrical devices. Suitable connections include soldered connections, solderless connections, mechanical contacts, quick disconnects, printed circuit board terminals, screw type terminals or any other conventional electrical connections.

Figure 2:
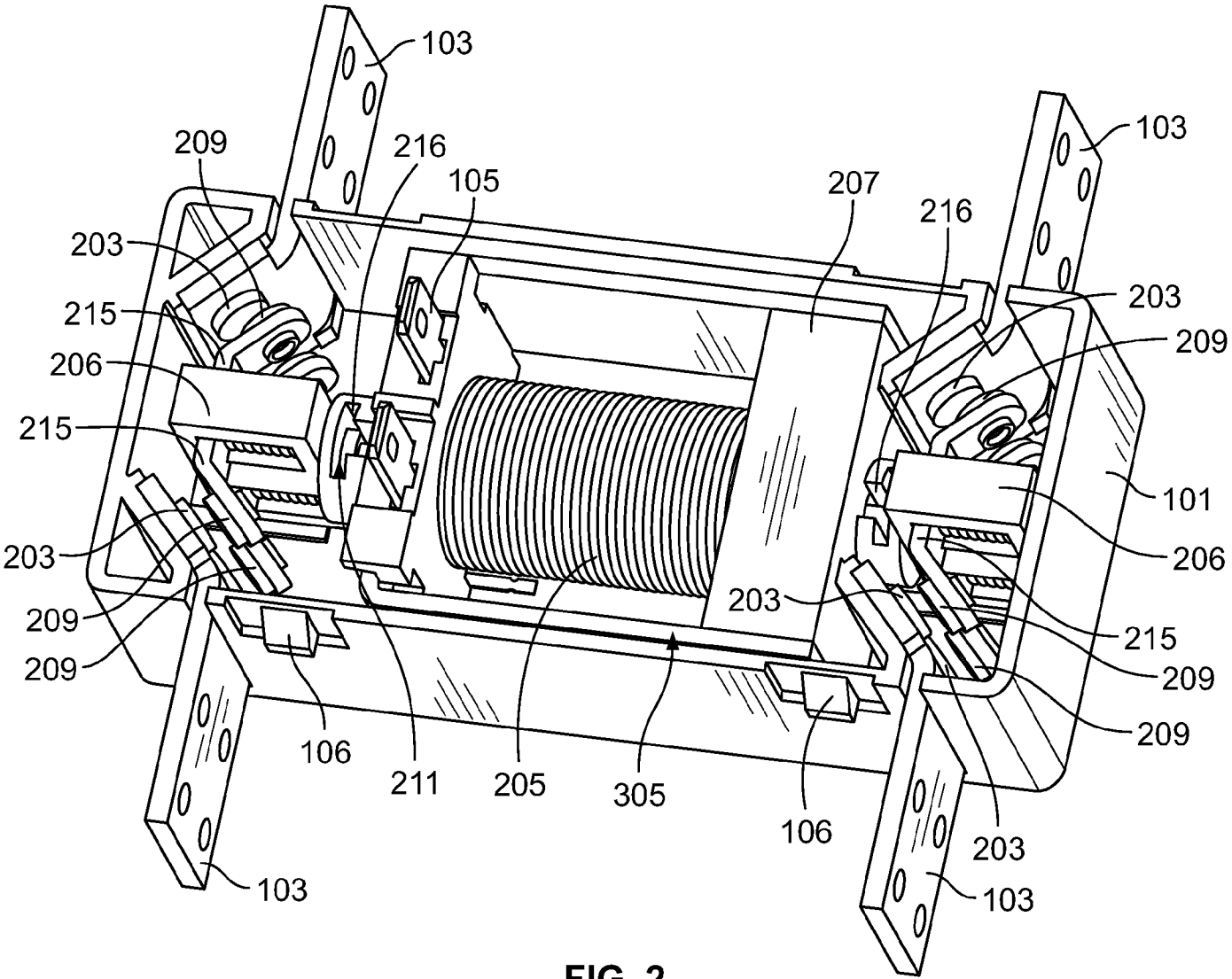
FIG. 2 is a top perspective view of the switch, similar to that of FIG. 1 with a cover removed to show the components housed in the switch housing.

Referring to FIG. 2, actuator assemblies 206 are mounted within base housing 101 in a manner that permits a motor assembly 207 to reciprocably move the actuator assemblies 206 in a direction toward and away from motor assembly 207. The movement of actuator assemblies 206 provides physical and electrical contact between moveable contacts 209 and stationary contacts 203, which provides electrical communication across the corresponding switch terminals 103. Switch terminals 103, stationary contacts 203, moveable contacts 209 and coil terminals 105 are fabricated from any suitable conductive material. Suitable conductive materials include, but are not limited to, copper, copper alloy, brass, bronze, silver plating, gold plating or any other conductive material.

Motor assembly 207 includes coil connections that physically contact and electrically communicate with the coil terminals 105. Although, as shown, the motor assembly is configured to receive an alternating current (AC), the motor assembly 207 may be configured to utilize a direct current (DC) signal. In addition, motor assembly 207 may be detachably connected to actuator assemblies 206 by armature 211 (best shown in FIG. 6). The armature 211 is reciprocably driven along an axis 213 to provide a corresponding reciprocating motion of the attached actuator assemblies 206. The actuator assemblies 206 are driven to a position between a first position that provides physical contact between moveable contacts 209 and stationary contacts 203 and a second position that does not provide contact between moveable contacts 209 and stationary contacts 203. The arrangement shown in FIG. 2 is a normally open circuit. However, the invention is not limited to the arrangement shown and may also include actuator assemblies 206 configured for normally closed circuits or combinations of normally open and normally closed circuits.

Figure 7A:
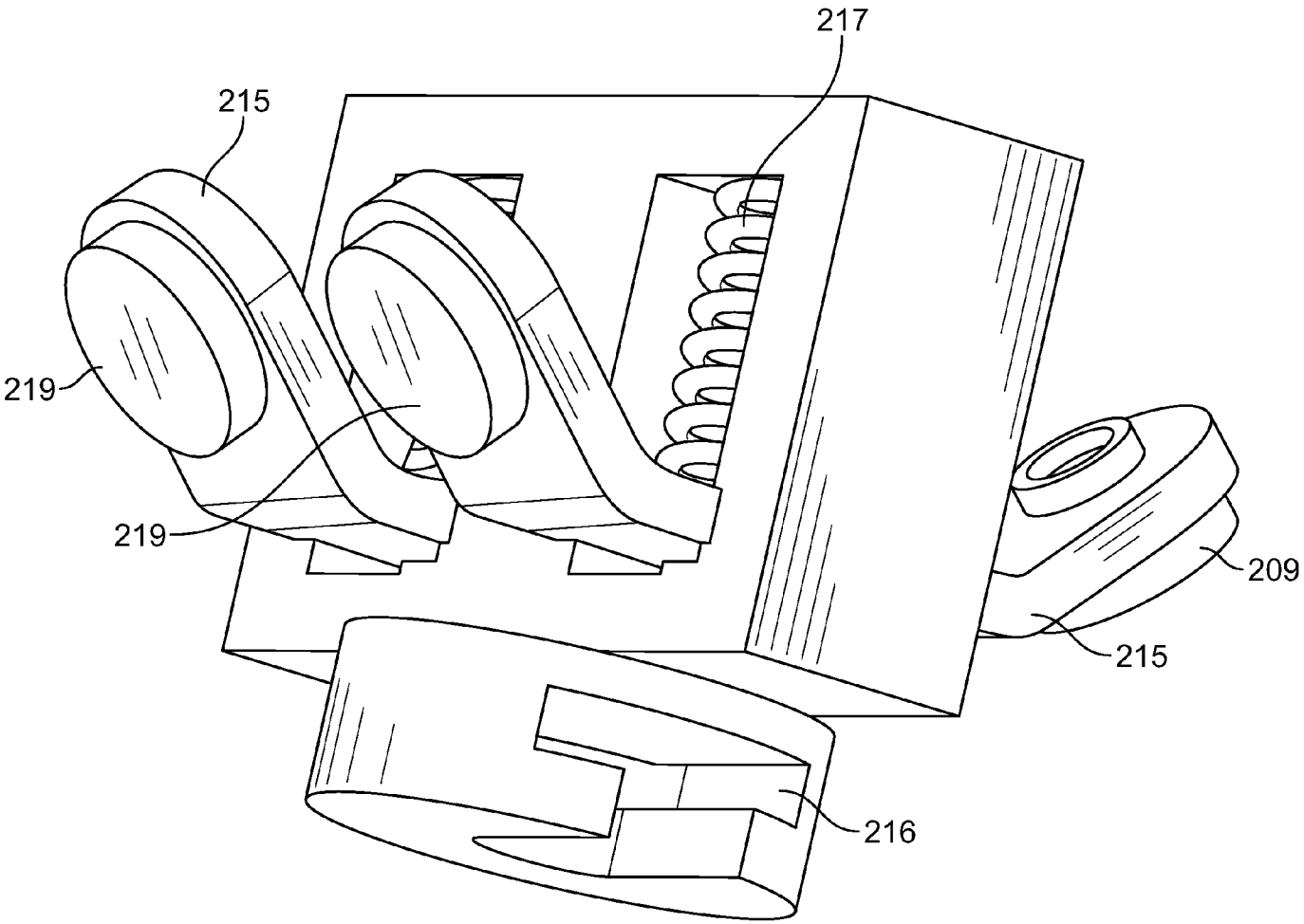
FIG. 7A is a perspective view of a first actuator assembly removed from the switch housing.
Figure 7B:
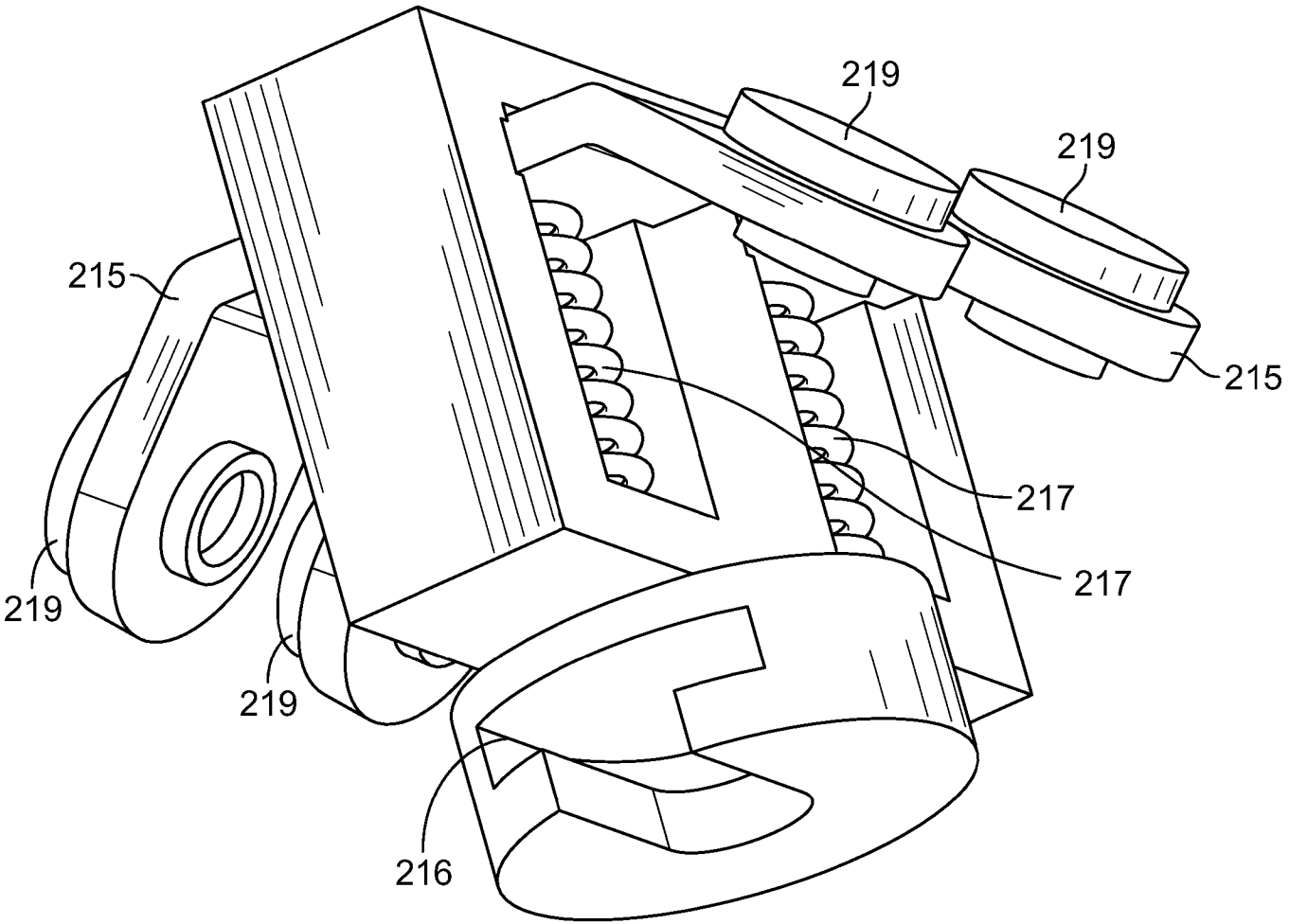
FIG. 7B is a perspective view of a second actuator assembly removed from the switch housing.

Referring to FIGS. 2, 7A and 7B, the actuator assemblies 206 include a plurality of bridges 215. Bridges 215 are fabricated from an electrically conductive material and are configured to receive and electrically communicate with moveable contacts 209. Suitable conductive materials include, but are not limited to, copper, copper alloy, bronze, brass, silver plating, gold plating or any other conductive material. The bridges 215 permit electrical connection between corresponding stationary contacts 203 when the actuator assemblies 206 are driven to a position that provides physical contact between moveable contacts 209 and stationary contacts 203. The actuator assemblies 206 further include bridge springs 217, which apply a force on the bridge 215, urging the bridge 215 and moveable contacts 209 in a direction toward the stationary contacts 203, which assists in maintaining physical contact between moveable contacts 209 and stationary contacts 203 and provides for reliable, reproducible electrical communication therebetween. The use of springs 217 can be particularly advantageous when the switch terminals 103 carry high current, as the repulsive force increases between contacts. The force supplied by the springs 217, in conjunction with the entire configuration of the switch assembly 100 minimizes the risk that the stationary contacts 203 and the moveable contacts 209 will be forced apart under extreme loads such as short circuit conditions. Armature engagements slots 216 are provided on bridges 215, the slots 216 being dimensioned to receive a portion of the armature 211 therein.

Referring to FIG. 2, base housing 101 may also be configured so that one or more switch terminals 103 are reversed such that stationary contacts 203 are located such that the stationary contacts 203 are intermediate to the motor assembly 207 and the actuator assemblies 206. Combinations of the positioning of the stationary contacts and the operation of the motor assembly 207 permit the actuator assemblies 206 to be configured for both normally open and normally closed circuits.

Figure 3:
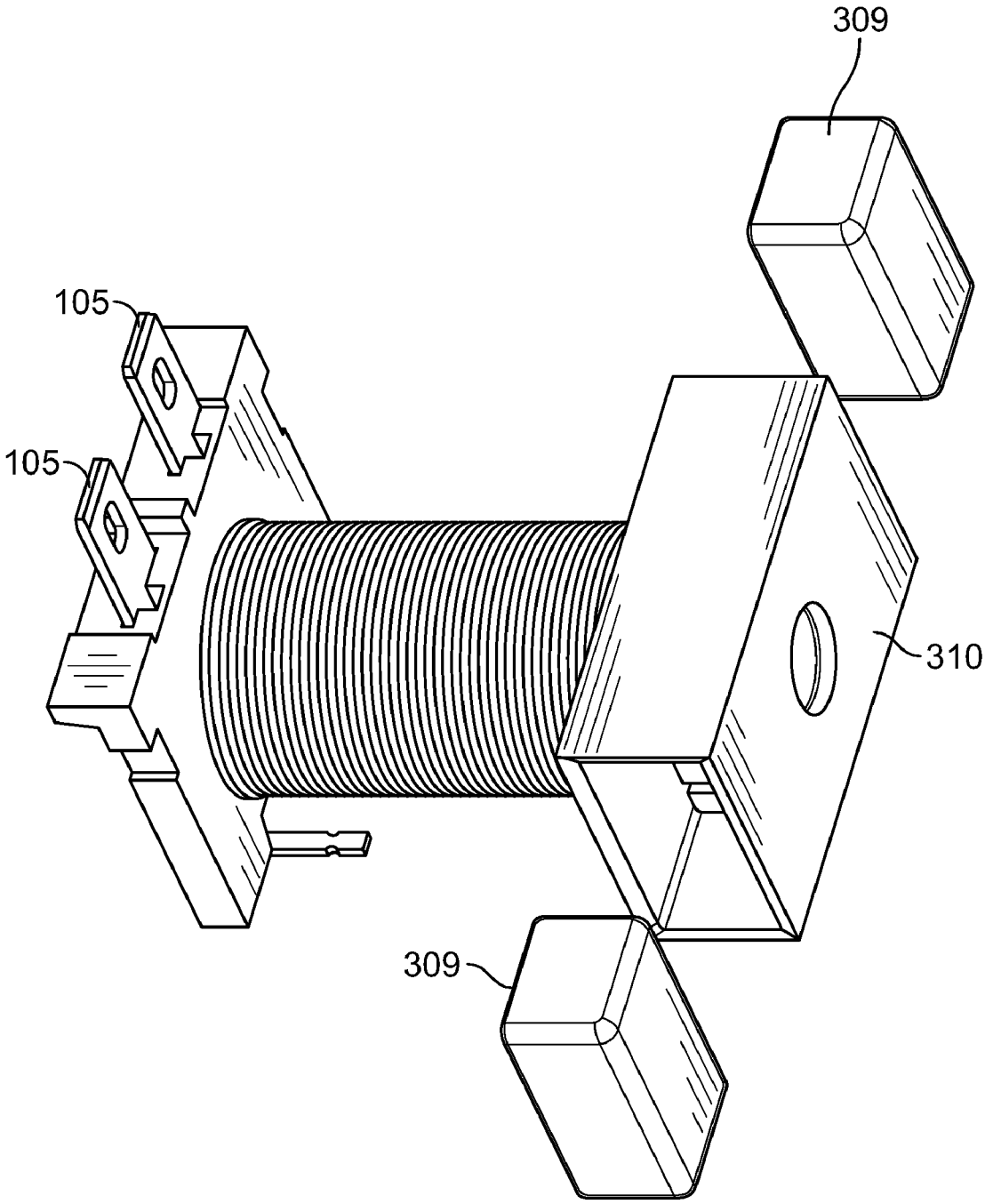
FIG. 3 is a perspective view of the coil assembly, with the magnets exploded therefrom.
Figure 4:
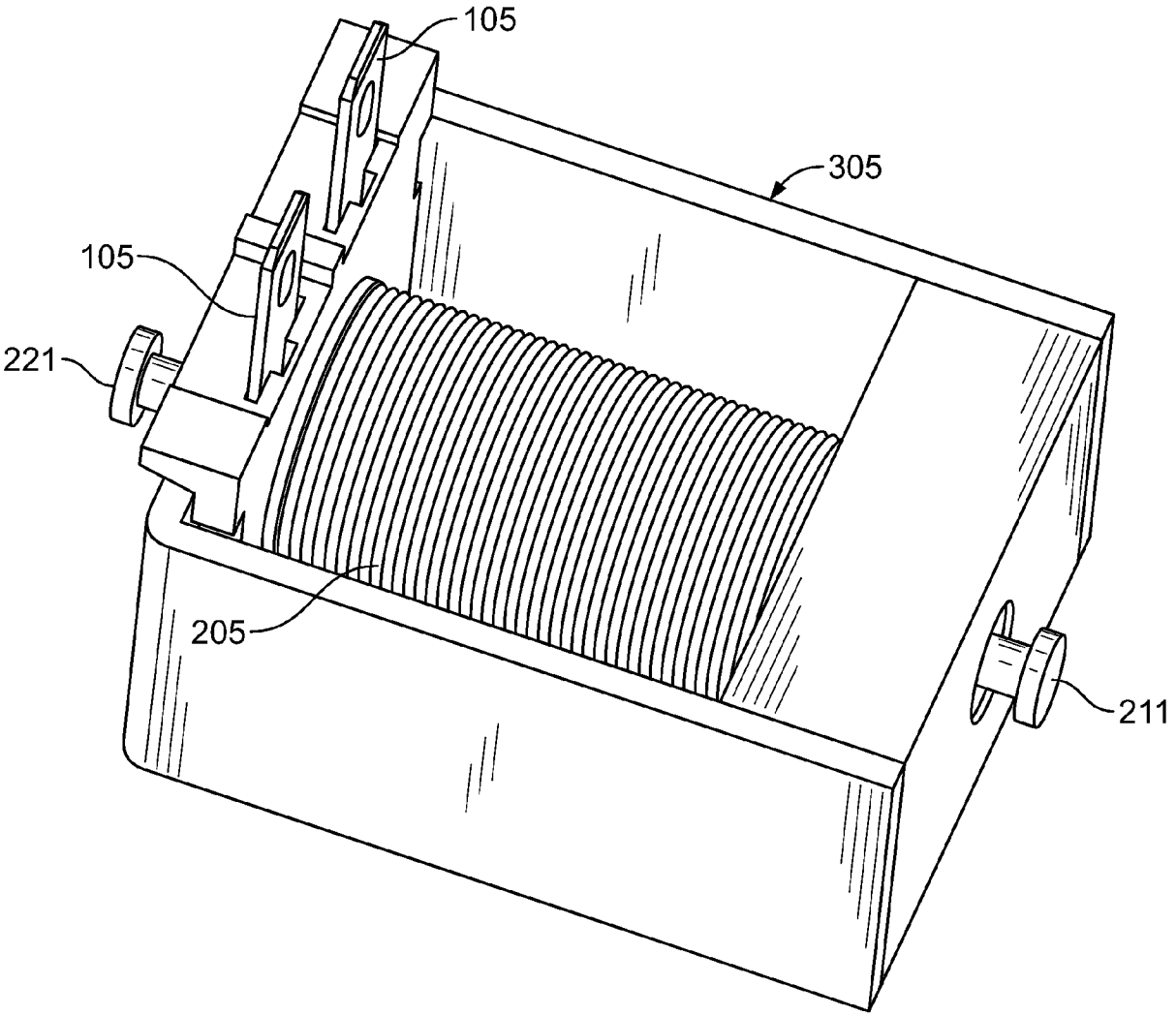
FIG. 4 is a top perspective view of the motor assembly.
Figure 5:
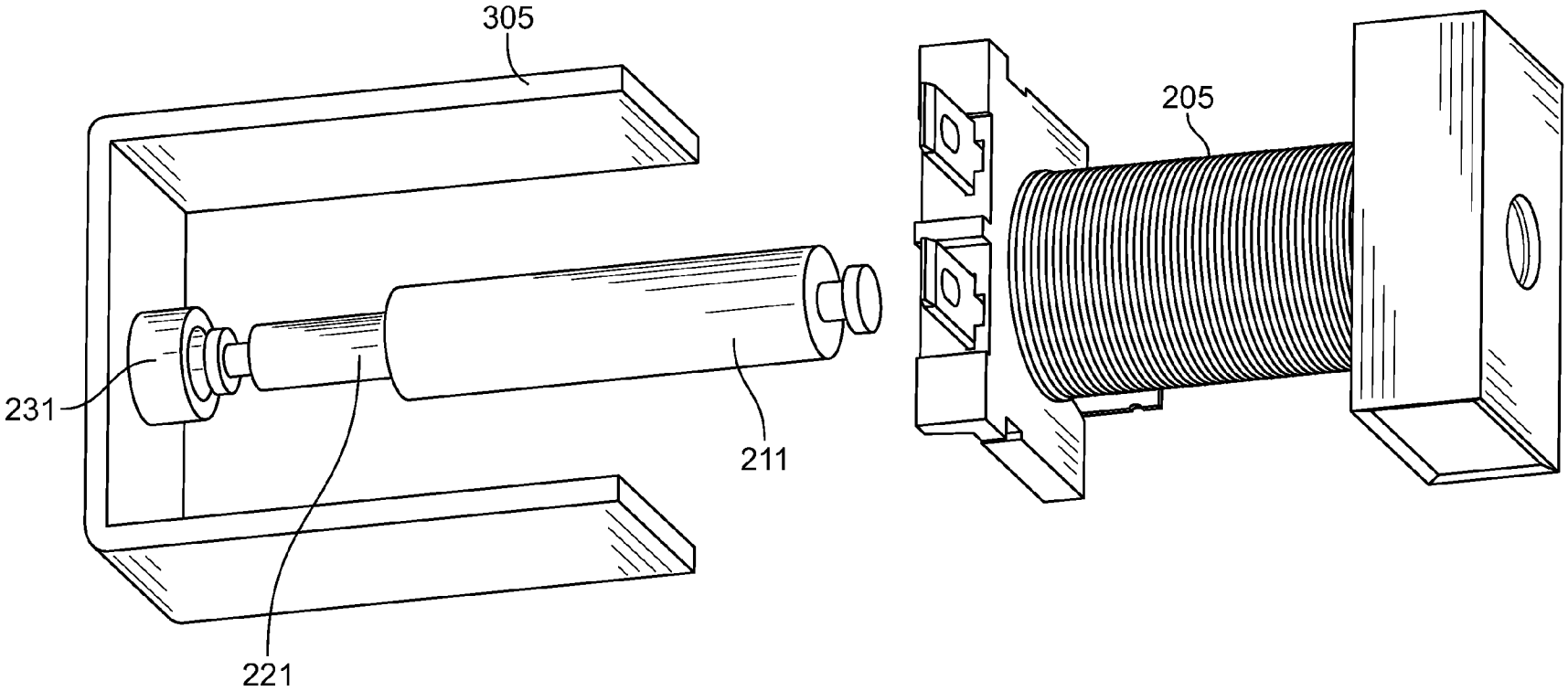
FIG. 5 is an exploded perspective view of the motor assembly.
Figure 6:
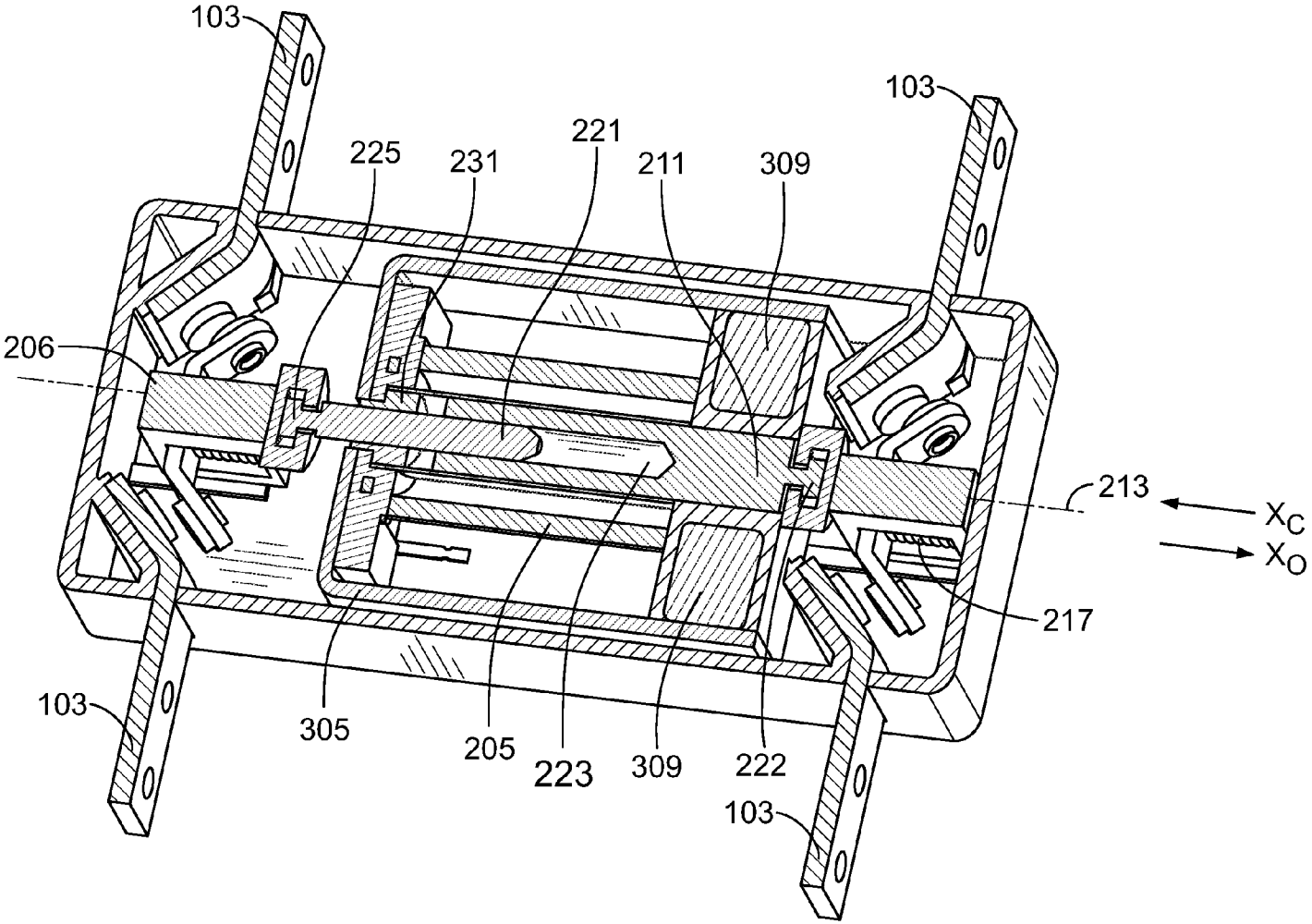
FIG. 6 is a perspective cross sectional view of the motor assembly shown in FIG. 2.

Motor assembly 207, as shown in FIGS. 3, 4 and 5, includes a coil assembly 205, which is configured as an electromagnetic arrangement preferably including a plurality of wire windings. For example, copper wire may be wound around a bobbin 310 to form coil assembly 205. The wire on coil assembly 205 is in electrical communication with coil terminals 105 and provides the coil assembly 205 with power to energize the electromagnetic coil assembly 205. A printed circuit board may be in electrical communication with components, such as diodes, to provide the desired current (i.e., convert AC current to DC current) to the coil assembly 205. As best shown in FIGS. 5 and 6, the coil assembly 205 is disposed within a solenoid frame 305. Solenoid frame 305 surrounds the coil assembly 205.

Coil assembly 205 is disposed about axis 213. In addition, armature 211 is disposed along axis 213, wherein at least a portion of the armature 211 is disposed within coil assembly 205. The armature 211, as shown in FIG. 6, has a cylindrical configuration with an actuator engagement projection 222 extending from one end thereof. The opposite end is hollowed out to form a coupler receiving opening 223. A coupler 221 is also cylindrical in configuration and is dimensioned to be received in the coupler receiving opening 223. An actuator engagement projection 225, similar to projection 222, extends from the end of the coupler 221 which is not positioned in opening 223. Coupler 221 is secured to armature 211 by crimping or other known means. For example, a projection could be provided on either the coupler or the armature which would snap into a respective recess on the other when the coupler and armature are fully mated. In the embodiment shown, coupler is made of plastic or other material which is easy to mold and/or form. The armature 211 is fabricated from a material that exhibits magnetic properties when exposed to a magnetic field. Suitable materials for the armature 211 include iron or iron alloys, preferably soft magnetic ferritic materials, that exhibit electromagnetic properties when exposed to a magnetic field.

A pole piece 231 is provided at the end of coil assembly 205. The pole piece 231 is housed within the motor assembly 207 and is fabricated from a material that exhibits magnetic properties. Suitable magnetic materials are any magnetic material including, but not limited to soft magnetic ferritic materials. The pole piece 231 is provided proximate the armature 211. Translation of the armature 211 from a first position in which the stationary contacts 203 and moveable contacts 209 are not engaged to a second position in which the stationary contacts 203 and moveable contacts 209 are engaged is by engerization of the coil assembly 205 by a current pulse or appropriate magnitude and polarity. Once the armature is seated to the pole piece, the permanent magnets hold the armature to the pole piece in the first position when the signal is removed from the coil. A second pulse by the opposite cycle of the signal is applied to the coil, thus causing the armature to move to the second position. A spring (not shown) is utilized to keep the armature in the second position once the signal is removed from the coil.

In the alternative, a closed magnetic loop may be provided allowing the permanent magnets 309 to maintain the armature 211 in both the first and second positions, thereby eliminating the need for the spring. The coil assembly 205 may either be single wound and fed with pulses of opposite polarities to effect movement in opposite directions, or double wound, enabling a pulse of the same polarity to be used to produce motion of the armature 211 is either direction when applied to the appropriate one of the two windings. In either case, pole piece 231 (FIG. 5) cooperates with armature to maintain the armature in position relative to the coil assembly 205 and prevent excess movement thereof.

When assembled, as shown in FIGS. 2 and 6, actuator engagement projections 222, 225 are positioned in respective armature engagement slots 216 of actuator assemblies 206. Consequently, as the armature 211 is moved to the first position, the actuator assemblies 206 are moved in the direction indicated by arrow Xo of FIG. 6. In this position, the moveable contacts 209 are physically and electrically disengaged from stationary contacts 203, thereby preventing the electrical current from being conducted across the bridges 215 of the actuator assemblies 206. In contrast, as the armature 211 is moved to the second position, the actuator assemblies 206 are moved in the direction indicated by arrow Xc of FIG. 6. In this position, the moveable contacts 209 are physically and electrically engaged with stationary contacts 203, thereby providing an electrically conductive path between a first switch terminal 103, a first stationary contact 203, a first moveable contact 209, the bridge 215, a second moveable contact 209, a second stationary contact 203 and a second switch terminal 103.

In the embodiment shown in FIGS. 2, 6, 7A and 7B, a portion of each respective switch terminal 103 and its respective contact terminal 203 are angled with respect to axis 213. Similarly, a respective portion of the bridge 215 and its respective moveable contacts 209 are angled to be positioned in a plane which is essentially parallel to the plane of the respective angled portion of the switch terminal. Consequently, as each moveable contact 209 is moved into engagement with its respective stationary contact 203, the surface of the moveable contact 209 will move across the surface of its respective stationary contact 203, causing the surface to frictionally engage as the movement occurs, resulting in a wiping action. This allows for a more reliable electrical connector, as any contamination will be removed from the surfaces, providing less resistance between the stationary contact and the moveable contact. This is particularly beneficial in no load or low load applications. The degree of angling can be adjusted to provide more or less wiping action, depending upon the circumstances. By angling the contacts and terminals in this fashion, the holding force provided in a direction parallel to the axis 213 may be lessened, but the contact force between the contacts is enhanced.

The switch assembly according to the present invention provides a low cost high voltage switch assembly which can be easily produced. As all of the movements of the assembly are in a direction parallel to the axis 213, the assembly can be manufactured and operated reliably in a relatively small space. In addition, the linear movement on the angled contact provides for a positive electrical connection even in adverse environments.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A switch assembly comprising:

a housing through which stationary contacts extend;

a motor assembly positioned within the housing;

an armature driven by the motor assembly between a first position and a second position, the armature having a first end and an oppositely facing second end;

a first actuator assembly and a second actuator assembly, the first actuator assembly extending from a first end of the armature, the second actuator assembly extending from the second end of the armature, the first actuator assembly and the second actuator assembly having moveable contacts, the first actuator assembly and the second actuator assembly moved by the armature such that the moveable contacts are in electrical engagement with the stationary contacts when the armature is in the first position, and the moveable contacts are spaced from the stationary contacts when the armature is in the second position, the stationary contacts and the moveable contacts are angled with respect to the direction of motion as the armature is moved between the first position and the second position, causing a contact force between the stationary contact and the moveable contacts to be enhanced and causing the moveable contacts to move across and frictionally engage the surface of the stationary contacts as the armature approaches the first position thereby providing a wiping action to remove contamination that may be present on the surfaces of the stationary contacts and moveable contacts;

wherein the movement of the armature and the movement of the moveable contacts are in the same linear direction.

2. The switch assembly as recited in claim 1 wherein the first actuator assembly and the second actuator assembly have conductive bridges with respective moveable contacts provided at either end thereof.

3. The switch assembly as recited in claim 2 wherein bridge springs are provided in engagement with at least one bridge, the bridge springs apply a force on the at least one bridge when the armature is in the first position, the force assists in maintaining the moveable contacts in electrical engagement with the stationary contacts.

4. The switch assembly as recited in claim 1 wherein the armature has a coupler extending therefrom, an opening is provided in the armature to receive the coupler therein, the second actuator assembly is attached to the coupler.

5. The switch assembly as recited in claim 4 wherein the coupler is secured to the armature by crimping.

6. The switch assembly as recited in claim 4 wherein the coupler is fabricated from a non-magnetic material which is easily molded.

7. The switch assembly as recited in claim 4 wherein the armature is fabricated from a material which exhibits magnetic properties when exposed to a magnetic field.

8. A switch assembly comprising:

a housing through which first and second stationary contacts extend;

a motor assembly positioned within the housing;

an armature driven by the motor assembly between a first position and a second position, the armature having a coupler receiving opening, the armature having a first end and an oppositely facing second end, the armature moveable a linear direction parallel to an axis of the armature;

a coupler extending from the second end of the armature, a portion of the coupler received in the coupler receiving opening;

a first actuator assembly with first moveable contacts, the first actuator assembly extends from the first end of the armature and is moved by the linear movement of the armature such that the first moveable contacts are in electrical engagement with the first stationary contacts when the armature is in the first position, and the first moveable contacts are spaced from the first stationary contacts when the armature is in the second position;

a second actuator assembly with second moveable contacts, the second actuator assembly extends from the coupler and is moved by the coupler such that the second moveable contacts are in electrical engagement with the second stationary contacts when the armature is in the first position, and the second moveable contacts are spaced from the second stationary contacts when the armature is in the second position;

the first and second stationary contacts and the first and second moveable contacts being angled with respect to the direction of motion as the armature and coupler are moved between the first position and the second position, causing the first and second moveable contacts to move across the surface of the first and second stationary contacts as the armature approaches the first position thereby providing a wiping action to remove contamination that may be present on the surfaces of the first and second stationary contacts and the first and second moveable contacts;

wherein the movement of the armature, the first movable contacts and the second moveable contacts are in the same linear direction and wherein the angling of the first and second stationary contacts and the first and second moveable contacts allows for the linear movement of the armature to effect a positive electrical connection between the stationary contacts and the movable contacts.

9. The switch assembly as recited in claim 8 wherein the first and second actuator assemblies have conductive bridges with respective first and second moveable contacts provided at either end thereof.

10. The switch assembly as recited in claim 9 wherein bridge springs are provided in engagement with the at least one bridge, the bridge springs apply a force on the at least one bridge when the armature is in the first position, the force assists in maintaining the first and second moveable contacts in electrical engagement with the first and second stationary contacts.

11. The switch assembly as recited in claim 8 wherein the coupler is secured to the armature by crimping.

12. The switch assembly as recited in claim 8 wherein the coupler is fabricated from a non-magnetic material which is easily molded.

13. The switch assembly as recited in claim 8 wherein the armature is fabricated from a material which exhibits magnetic properties when exposed to a magnetic field.

14. A switch assembly comprising:

a housing through which first and second stationary contacts extend;

a motor assembly within the housing;

an armature driven by the motor assembly between a first position and a second position, the armature having a first end and an oppositely facing second end;

the armature having a coupler extending from the second end of armature, the coupler being fabricated from a non-magnetic material and the armature being fabricated from a material which exhibits magnetic properties when exposed to a magnetic field;

a first actuator assembly with first moveable contacts, the first actuator assembly extending from the first end of the armature and being moved by the armature such that the first moveable contacts are in electrical engagement with the first stationary contacts when the armature is in the first position, and the first moveable contacts are spaced from the first stationary contacts when the armature is in the second position;

a second actuator assembly with second moveable contacts, the second actuator assembly extending from the coupler and being moved by the coupler such that the second moveable contacts are in electrical engagement with the second stationary contacts when the armature is in the first position, and the second moveable contacts are spaced from the second stationary contacts when the armature is in the second position.

15. The switch assembly as recited in claim 14 wherein an opening is provided in the armature, the opening receiving the coupler therein.

16. The switch assembly as recited in claim 15 wherein the coupler is secured to the armature by crimping.

17. The switch assembly as recited in claim 14 wherein the first and second actuator assemblies have conductive bridges with respective first and second moveable contacts provided at either end thereof.

18. The switch assembly as recited in claim 17 wherein bridge springs are provided in engagement with the first and second bridges, the bridge springs apply a force on the first and second bridges when the armature is in the first position, the force assists in maintaining the first and second moveable contacts in electrical engagement with the first and second stationary contacts.

19. The switch assembly as recited in claim 14 wherein the first and second stationary contacts and the first and second moveable contacts are angled with respect to the direction of motion as the armature is moved between the first position and the second position, causing the first and second moveable contacts to move across the surface of the first and second stationary contacts as the armature approaches the first position thereby providing a wiping action to remove contamination that may be present on the surfaces of the first and second stationary contacts and the first and second moveable contacts.

* * * * *